US008042296B1

(12) United States Patent
Kirstein

(10) Patent No.: US 8,042,296 B1
(45) Date of Patent: Oct. 25, 2011

(54) SEMIAUTOMATIC OR FULLY AUTOMATIC FIREARM

(76) Inventor: Gerhard Kirstein, Augsburg (DE)

( * ) Notice: Subject to any disclaimer, the term of this patent is extended or adjusted under 35 U.S.C. 154(b) by 397 days.

(21) Appl. No.: 12/337,860

(22) Filed: Dec. 18, 2008

(30) Foreign Application Priority Data

Dec. 27, 2007 (DE) ..... 10 2007 063 292

(51) Int. Cl.
*F41A 3/00* (2006.01)

(52) U.S. Cl. ..... 42/16; 42/2; 42/14

(58) Field of Classification Search ..... 42/2–49.1; 89/17, 22, 24, 180, 181, 187.01
See application file for complete search history.

(56) References Cited

U.S. PATENT DOCUMENTS

| | | | | |
|---|---|---|---|---|
| 2,869,563 | A * | 1/1959 | Schoengrun | 137/43 |
| 4,037,344 | A * | 7/1977 | Reed | 42/16 |
| 4,757,629 | A * | 7/1988 | Austin | 42/84 |
| 6,668,478 | B2 * | 12/2003 | Bergstrom | 42/1.06 |
| 7,541,563 | B1 * | 6/2009 | Pal | 244/3.1 |
| 7,624,727 | B2 * | 12/2009 | Campo | 124/77 |
| 2010/0031552 | A1 * | 2/2010 | Houde-Walter | 42/72 |

FOREIGN PATENT DOCUMENTS

| | | | |
|---|---|---|---|
| AT | 500 036 | A1 | 10/2005 |
| AT | 500036 | A1 | 10/2005 |
| DE | 1 001 060 | B | 1/1957 |
| DE | 31 30 761 | A1 | 3/1983 |
| DE | 100 61 914 | A1 | 6/2002 |
| DE | 10 2004 021 952 | B3 | 12/2005 |
| EP | 0071795 | | 2/1983 |
| WO | WO 2005/108900 | A1 | 11/2005 |

* cited by examiner

*Primary Examiner* — Michael Carone
*Assistant Examiner* — Joshua Freeman
(74) *Attorney, Agent, or Firm* — Ostrolenk Faber LLP

(57) ABSTRACT

Semiautomatic or fully automatic firearm, in particular in the form of a rifle or a pistol, containing a barrel whose rear barrel end is in the form of a cartridge chamber into which a projectile can in each case be inserted from the rear; a breech body which is arranged in a breech guide between the cartridge chamber and a rear wall such that it can move in the longitudinal direction between an open position, which releases the cartridge chamber in order to load a projectile, and a closed position which closes the cartridge chamber, wherein, in the closed position, the breech body closes the cartridge chamber at the rear and is used as an opposing bearing for the cartridge case; characterized in that at least one permanent magnet is provided such that, at least in the closed position and in the positions close to the closed position, its magnetic field forces the breech body to the closed position, such that the magnetic force of the at least one permanent magnet simulates a higher mass of the breech body, which acts as an opposing bearing during the firing of a projectile.

14 Claims, 6 Drawing Sheets

SEMIAUTOMATIC OR FULLY AUTOMATIC FIREARM

BACKGROUND OF THE INVENTION

The invention relates to a semiautomatic or fully automatic firearm, in particular in the form of a rifle or a pistol, containing a barrel whose rear barrel end is in the form of a cartridge chamber into which a projectile can in each case be inserted from the rear; a breech body which is arranged in a breech guide between the cartridge chamber and a rear wall such that it can move in the longitudinal direction between an open position, which releases the cartridge chamber in order to load a projectile, and a closed position which closes the cartridge chamber, wherein, in the closed position, the breech body closes the cartridge chamber at the rear and is used as an opposing bearing for the cartridge case.

The invention relates to a firearm with a locked breech and to firearms with an unlocked breech.

PRIOR ART

DE 31 30 761 A1 discloses an automatic handheld firearm, in particular an automatic pistol.

DE 10 2004 021 952 B3 discloses a self-loading handheld firearm.

FIG. 7 of German Laid-Open Specification 1 001 060 illustrates a firearm having a magnetic return system which has at least one permanent magnet in order to move a firing bolt back after a projectile has been fired.

Automatic firearms contain a plurality of moving parts, in particular a movable breech body. The breech body should have a high mass in order to withstand the recoil force of the projectile and the recoil forces of the hot gases from the projectile propellant charge. A high material mass makes the firearm heavy. For reasons associated with the capability of the parts to move and the relatively high mass of the breech, the aiming accuracy of automatic firearms is normally not as good as that of repeater rifles.

SUMMARY OF THE INVENTION

The aim of the invention is to solve the problem of improving the aiming accuracy (aiming precision) of automatic firearms, in a simple manner.

According to the invention, this problem is solved by a semiautomatic or fully automatic firearm, in particular in the form of a rifle or a pistol, comprising a barrel whose rear barrel end is in the form of a cartridge chamber into which a projectile can in each case be inserted from the rear. A breech body is arranged in a breech guide between the cartridge chamber and a rear wall such that it can move in the longitudinal direction between an open position, which releases the cartridge chamber in order to load a projectile, and a closed position closes the cartridge chamber, wherein, in the closed position, the breech body closes the cartridge chamber at the rear and is used as an opposing bearing for the cartridge case. At least one permanent magnet is provided such that, at least in the closed position and in the positions close to the closed position, its magnetic field forces the breech body to the closed position and the magnetic force of at least one permanent magnet simulates a higher mass of the breech body, which acts as an opposing bearing during the firing of a projectile.

According to the invention, a semiautomatic or fully automatic firearm is characterized in that at least one permanent magnet is provided such that, at least in the closed position and in the positions close to the closed position, its magnetic field forces the breech body to the closed position, such that the magnetic force of the at least one permanent magnet simulates a higher mass of the breech body, which acts as an opposing bearing during the firing of a projectile.

The invention advantageously increases the breech body force with which the breech body opposes the recoil forces of the projectile and the propellant-charge gases when a projectile is fired. The at least one permanent magnet simulates a higher mass of the breech body during the firing of a projectile, without the breech body having to be large and heavy in order to actually have the higher mass.

The invention increases the aiming accuracy of automatic firearms. The invention results in the aiming accuracy of automatic firearms being close to the aiming accuracy of repeater rifles.

The preferred field of application of the invention is, in particular but not exclusively, sporting weapons and firearms for sharpshooters.

The invention can be applied to all self-loading firearms.

For the purposes of the invention, a magnetic force can be produced not only between two or more permanent magnets but also between one or more permanent magnets on the one hand and a body which is composed of ferromagnetic or ferrimagnetic material, or contains such a material, on the other hand.

Instead of or in addition to the one and/or the other of the two above-mentioned options of magnetic attraction, it is also possible to force the breech body to its closed position by means of permanent magnets which magnetically repel one another.

According to one particular embodiment of the invention, the breech body and/or a body which forms the barrel and the cartridge chamber are/is themselves/itself magnetized as a permanent magnet or magnets such that it or they itself or themselves forms or form at least one of the at least one permanent magnets.

According to a further advantageous embodiment of the invention, in addition to the at least one permanent magnet, a spring can also be provided and is arranged such that it forces the breech body to the closed position.

BRIEF DESCRIPTION OF THE DRAWINGS

The invention will be described in the following text with reference to the attached drawings and on the basis of a plurality of embodiments as examples. In the drawings:

Of a firearm 2 according to the invention, FIGS. 1 and 2 show a barrel 4 and a breech body 6. The rear section of the barrel 4 is in the form of a cartridge chamber 8. The breech body 6 can be moved in the longitudinal direction of the barrel 4, in a breech guide 10, between the closed position as shown in FIG. 1 and the open position as shown in FIG. 2.

DESCRIPTION OF PREFERRED EMBODIMENTS

Figure 1:
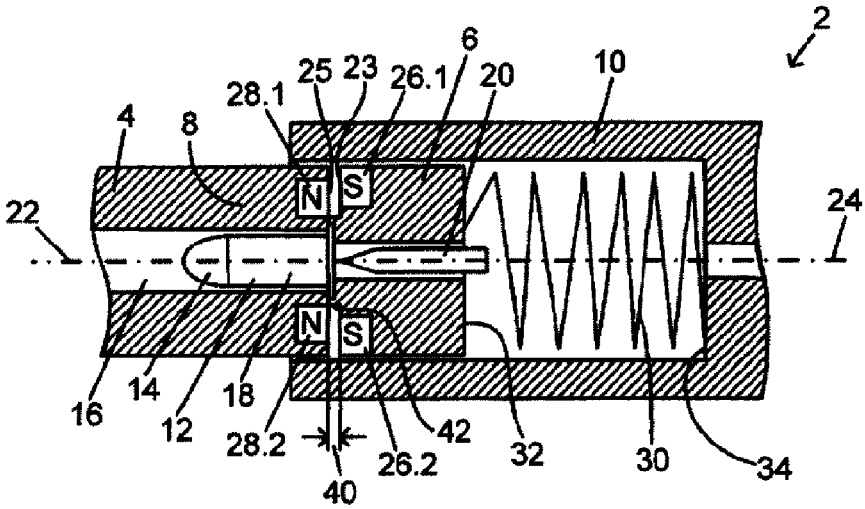
FIG. 1 shows a cut-off longitudinal section of a firearm according to the invention, showing a breech body in the closed position.

In the closed position as shown in FIG. 1, the breech body 6 forms an opposing bearing for absorbing the recoil of a projectile 12 in the cartridge chamber 8 when the propellant charge (not shown) of the projectile 12 is fired. When the propellant charge of the projectile 12 is fired, the cartridge 14 of the projectile 12 is driven through the bore 16 of the barrel 4, while the cartridge case 18 is held in the cartridge chamber 8 by the breech body 6 against the explosion pressure of the propellant charge.

Figure 2:
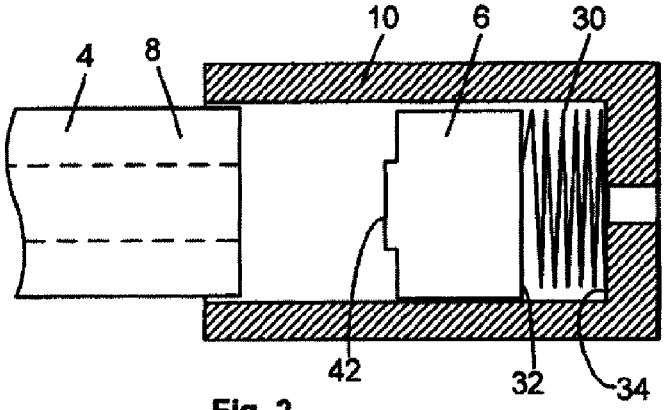
FIG. 2 shows, schematically, the longitudinal section through the firearm shown in FIG. 1, with the breech body being shown in its open position.

After firing, the breech body 6 is moved back to the open position as shown in FIG. 2. During this process, the cartridge case 18 is ejected from the breech guide 10, as a result of which a new projectile 12 can then automatically be inserted into the cartridge chamber 8.

In order to fire the propellant charge of the projectile 12, a firing bolt 20 strikes the center of the rear face of the projectile 12.

In order to describe the invention, FIG. 1 shows the bore axis 22 of the barrel 4 and a center axis 24 (center line), which is aligned with this bore axis 22, of the breech body 6.

In the firearm 2 shown in FIG. 1, the breech body 6 has, for example at its front end, at least one permanent magnet 26 (26.1-**26.*n*), for example two permanent magnets 26.1 and 26.2, of which one magnetic pole, for example the south pole is in each case opposite, in the longitudinal direction of the barrel 4, a dissimilar magnetic opposing pole, for example the north pole "N" of permanent magnets 28 (28.1-28.*n*), for example permanent magnets 28.1 and 28.2, which are provided at the rear end 25 of the cartridge chamber 8. In consequence, the mutually opposite permanent magnets 26 and 28 attract one another in the barrel longitudinal direction, and thus draw the breech body 6 to its closed position against the cartridge chamber 8**, and hold it in the closed position.

The permanent magnets 26 are preferably arranged on the front end face 23 of the breech body 6 or are integrated in this front end face 23, for example by being arranged flush or recessed, or being formed by the breech body 6 itself.

The permanent magnets 28 are preferably arranged on the rear end face 25 of the cartridge chamber 8 or are integrated in this rear end face 25, for example by being arranged flush or recessed.

In addition, a spring 30 can also be provided, for example a compression spring, which is clamped in in the barrel longitudinal direction between the rear face 32 of the breech body 6 and a rear wall 34, which is opposite it in the barrel longitudinal direction, of the breech guide 10, thus forcing the breech body 6 to its closed position.

Figure 3:
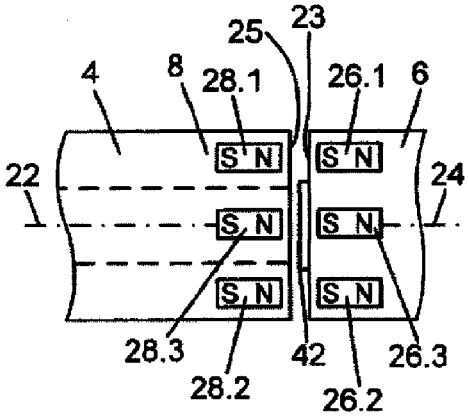
FIG. 3 shows, schematically, a side view of the barrel and of a breech body of the firearm shown in FIG. 1, with a special arrangement of permanent magnets.

The permanent magnets 26 and 28 may have any desired shapes. For example, FIG. 3 shows a cartridge chamber 8 with the permanent magnets 28.1, 28.2 and 28.3 in the form of bar magnets, as well as a breech body 6 with permanent magnets 26.1, 26.2 and 26.3 in the form of bar magnets. The bar magnets extend in the barrel longitudinal direction. In this case, the south poles "S" of the permanent magnets 26 are opposite the north poles "N" of the permanent magnets 28 in the longitudinal direction of the barrel 4.

Figure 4:
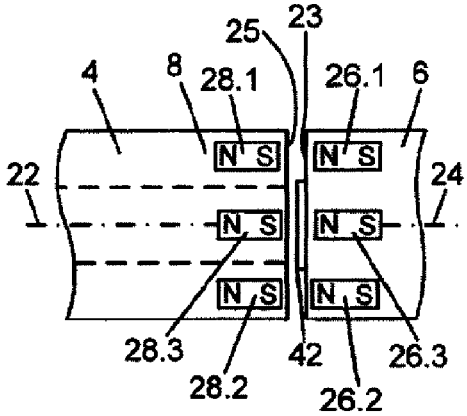
FIG. 4 shows a schematic side view of the barrel and of the breech body shown in FIG. 1, with a further embodiment of an arrangement of permanent magnets.

FIG. 4 shows an arrangement similar to that in FIG. 3, but with the permanent magnets 26 and 28 being arranged reversed, such that the north poles of the permanent magnets 26 are opposite the south poles of the permanent magnets 28 in the barrel longitudinal direction.

According to another embodiment of the invention, the permanent magnets 26 and 28 of the breech body 6 and of the cartridge chamber 8 are arranged such that south poles and north poles follow one another alternately in the circumferential direction around the center axis 24.

In the embodiments shown in FIGS. 3 and 4, the bar magnets 26 and 28 each extend in the barrel longitudinal direction.

Figure 5:
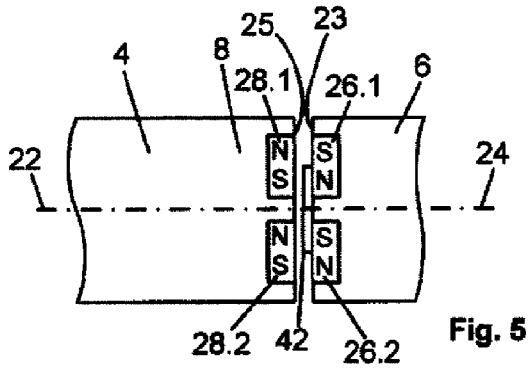
FIG. 5 shows, schematically, a side view of the barrel and of the breech body shown in FIG. 1, with yet another embodiment of an arrangement of permanent magnets.

In the embodiment shown in FIG. 5, the bar magnets and 28 (26.1, 26.2, 28.1, 28.2) each extend in the circumferential direction with respect to the bore axis 22 of the barrel 4 and with respect to the center axis 24 of the breech body 6.

Figure 6:
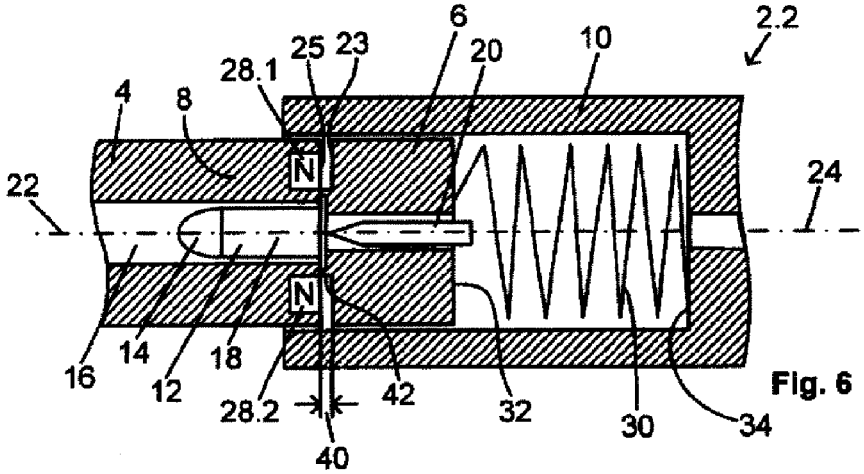
FIG. 6 shows, schematically, a cut-off longitudinal section of a further embodiment of a firearm according to the invention.

FIG. 6 shows an embodiment, similar to that shown in FIG. 1, of a firearm 2.2 according to the invention. In this case, at least one, for example two permanent magnets 28.1 and 28.2, are once again attached to the rear end 25 of the cartridge chamber 8 of the barrel 6, as has been described above with reference to FIGS. 1 to 5. However, the breech body 6 does not have any permanent magnets at its front end 23 axially opposite the cartridge chamber 8 but, at least at its front end 23, is composed of ferromagnetic or ferrimagnetic material, or contains a material such as this there, which is attracted by the magnetic field of the permanent magnets 28.1 and 28.2.

Figure 7:
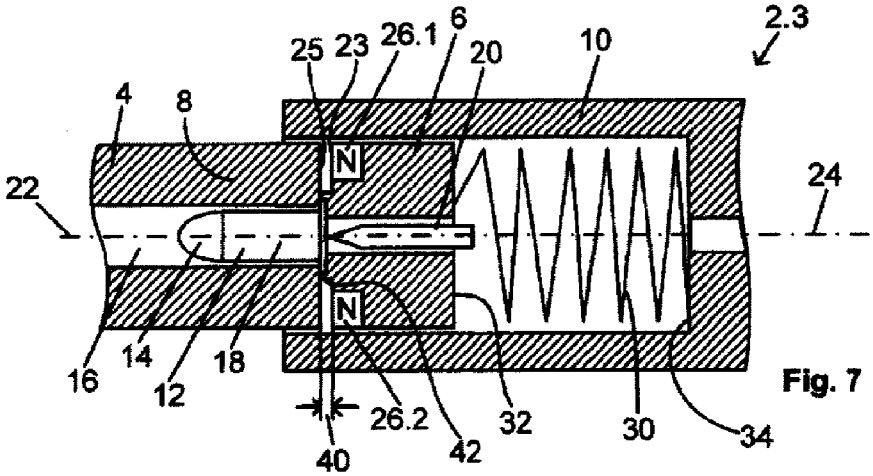
FIG. 7 shows, schematically, a cut-off longitudinal section through yet another embodiment of a firearm according to the invention.

FIG. 7 shows one embodiment of a firearm 2.3 according to the invention, in which the breech body 6 has at least one permanent magnet 26, for example two permanent magnets 26.1 and 26.2, as has been described above with reference to FIGS. 1 to 5, in a known manner on its front end 23 axially opposite the cartridge chamber 8. However, that end 25 of the cartridge chamber 8 which faces backwards is not provided with a permanent magnet but is composed of ferromagnetic or ferrimagnetic material, or contains a material such as this, by which the breech body 6 is magnetically attracted by means of the magnetic field of the permanent magnets 26 in the barrel longitudinal direction. Instead of or in addition to this, an element which is adjacent to the cartridge chamber 8 and is arranged axially in a fixed position in the longitudinal direction of the barrel 4, for example the front section of the breech guide 10, could also be composed of ferromagnetic or ferrimagnetic material, or could have such a material.

Figure 8:
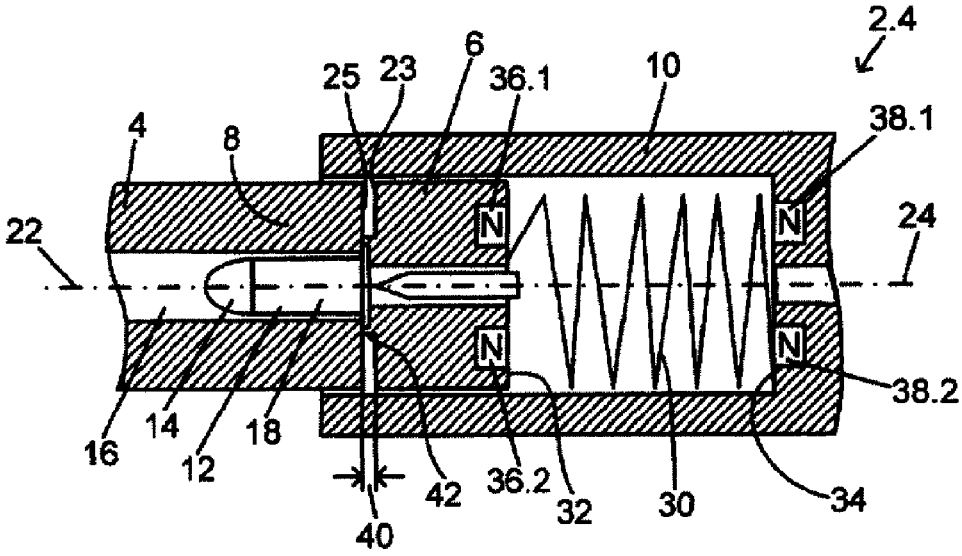
FIG. 8 shows, schematically, a cut-off longitudinal section through yet another embodiment of a firearm according to the invention.

FIG. 8 schematically illustrates one embodiment of a firearm 2.4 according to the invention, in which at least one, for example two or more, permanent magnets 36 (36.1 and 36.2) is or are mounted on the rear face 32 of the breech body 6 and may be formed in a corresponding manner to the permanent magnets in FIGS. 1 to 5. At least one, preferably two or more, permanent magnets 38, for example 38.1 and 38.2 is or are attached to the breech rear wall 34 such that its or their magnet poles is or are opposite similar magnet poles of the permanent magnets 36 of the breech body 6 in the barrel longitudinal direction, such that they repel one another and thus can force the breech body 6 in the direction from its open position to its closed position, and can hold it in the closed position by the permanent magnetic field.

FIG. 8 shows mutually opposite north poles of the permanent magnets 36 on the one hand and of the permanent magnets 38 on the other hand. However, according to another embodiment, the south poles "S" could be arranged axially opposite one another.

The permanent magnets 26 and 28 in the embodiments shown in FIGS. 1 to 7 are preferably arranged such that an axial air gap 40 remains between them and the opposing element which is magnetically attracted by them and may likewise be a permanent magnet or, in the stated manner, ferromagnetic or ferrimagnetic material, when the breech body 6 is in the closed position as illustrated in FIGS. 1, 6 and 7. For example, on its front face, the breech body 6 may have an axial projection 42 which, when the breech body 6 is in the closed position, can rest on the rear end surface 25 of the cartridge chamber 8 thus holding the mutually attracting permanent magnets 26 and 28 from FIGS. 1 to 5 at an axial distance, or, in the embodiment shown in FIG. 6, holding the at least one permanent magnet 28 of the barrel 4 at an axial distance from the front end surface 23 of the breech body 6, or holding the at least one permanent magnet 26 of the breech body 6 as shown in FIG. 7 at an axial distance from the rear end surface 25 of the barrel 4. According to another embodiment, the projection 42 can be axially supported on the projectile 12. According to yet another embodiment, an axial projection could also be provided at the rear end of the barrel 6 or of the cartridge chamber 8. According to yet another embodiment, the at least one permanent magnet 26 of the breech body 6 could be arranged set back (recessed) in the breech body 6, and/or the at least one permanent magnet 28 could be arranged set back (recessed) axially in the cartridge chamber 8.

Figure 9:
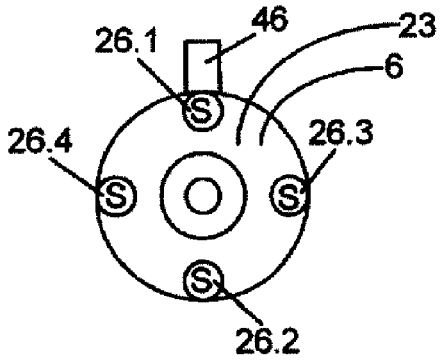
FIG. 9 shows a front end view of the breech body shown in FIG. 1, with an operating element added.
Figure 10:
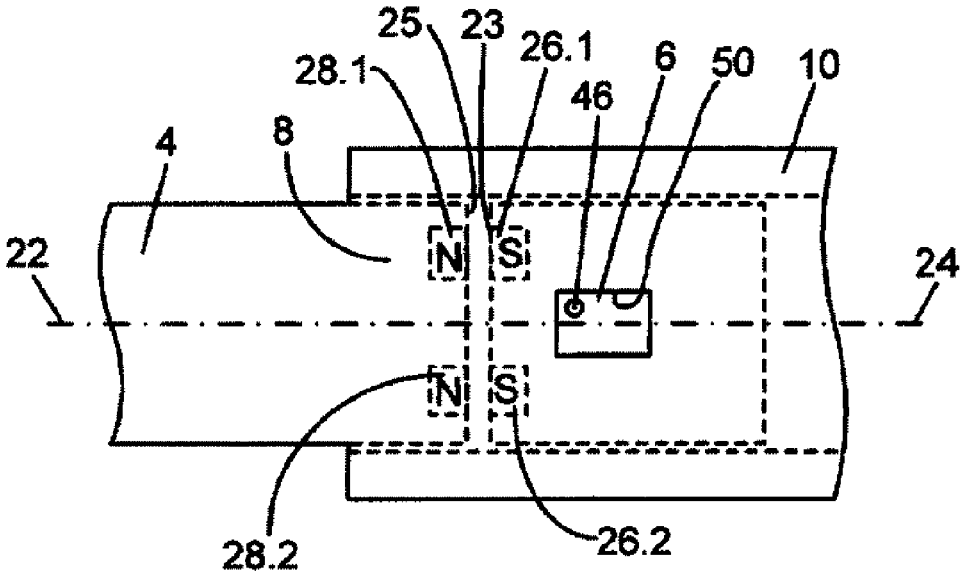
FIG. 10 shows, schematically, a side view of a further embodiment of a firearm according to the invention with the breech body shown in FIG. 9 in its closed position, in which mutually attracted permanent magnets are arranged aligned with one another in the barrel longitudinal direction.

FIG. 9 shows, schematically, a front end view of the breech body 6 shown in FIG. 1, but also having an operating element 46, for example a lever which projects radially. By way of example, four permanent magnets 26.1, 26.2, 26.3 and 26.4 of the at least one permanent magnet 26 are shown.

Figure 11:
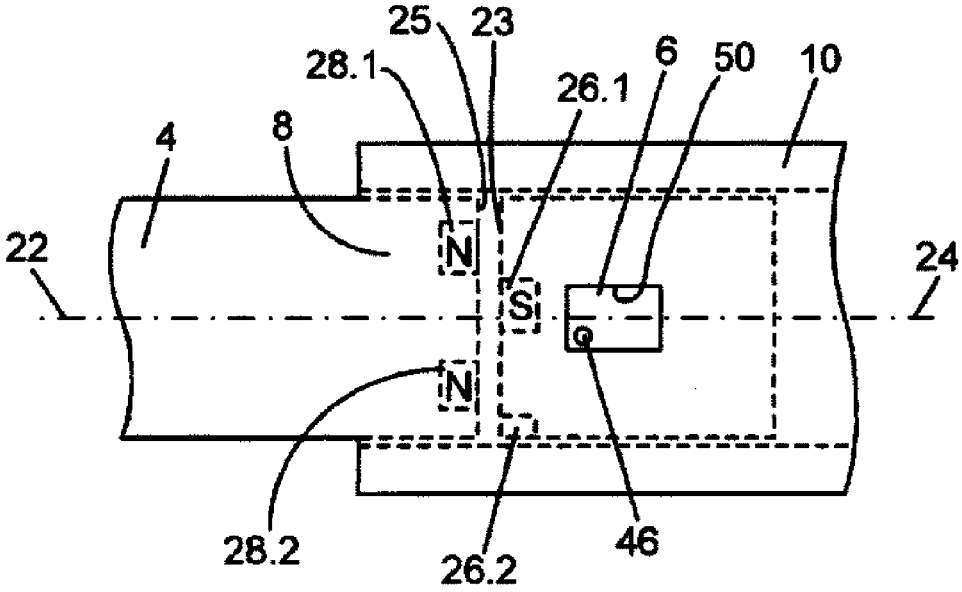
FIG. 11 shows the same side view as in FIG. 10, but with the breech body in a position rotated relative to the barrel, in which the permanent magnets which are provided for mutual attraction are arranged in the barrel longitudinal direction less or no longer aligned with one another.

The operating element 46 of the breech body 6 is located behind a side aperture opening 50, or projects into this aperture opening 50, or through this aperture opening 50, which is formed in the breech guide 10. The breech body 6 can thus be rotated relative to the barrel 4 by means of the operating element 46 about the center axis 24 between a magnetically active position, in which the permanent magnets 26 and 28 which magnetically attract one another are arranged opposite one another, essentially completely aligned with one another, in the barrel longitudinal direction, and a magnetically inactive position, such that, in the magnetically inactive position, the at least one permanent magnet 26 of the breech body 6 is positioned rotationally offset with respect to the at least one permanent magnet 28 of the barrel 4, as a result of which the magnetic attraction force is considerably reduced in the magnetically inactive position, which is shown in FIG. 11, or is inactive in comparison to the magnetically active position which is shown in FIGS. 10 and 1 to 5. This results in a strong magnetic opposing force for firing of a cartridge 14, but a considerably reduced, or no magnetic attraction force for the return movement or opening of the breech body 6, for the ejection of the cartridge case 18 and for the insertion of a new projectile 12. This makes it considerably easier for the breech body 6 to move back, particularly during the initial movement from the closed position.

The at least one permanent magnet of the breech body 6, for example the permanent magnets 26 (26.1 . . . **26.*n*) and 36 (36.1 . . . 36.*n*) may, in all embodiments of the invention, be an element added to the breech body 6 or may be formed by the breech body 6** itself, in that the breech body is composed at least partially of material which can be magnetized, and this material which can be magnetized is magnetized as a permanent magnet.

In all of the embodiments described above, in which at least one permanent magnet is arranged on or in the cartridge chamber 8, for example the permanent magnets 28 (28.1 . . . **28.*n*) in FIGS. 1 to 6 and FIGS. 10 and 11, which magnetically draw the breech body 6 to its closed position, these permanent magnets could also be provided on another element which forms an integral part with the cartridge chamber 8, is attached to the cartridge chamber 8 or can be positioned axially in a fixed position in the longitudinal direction of the barrel 4 in some other manner, such that it cannot be moved in the longitudinal direction of the barrel 4 while a shot is being fired. By way of example, one such element may also be the breech guide 10**.

The rear wall 34 may be a part of the breech guide 10 or an additional part.

Figure 12:
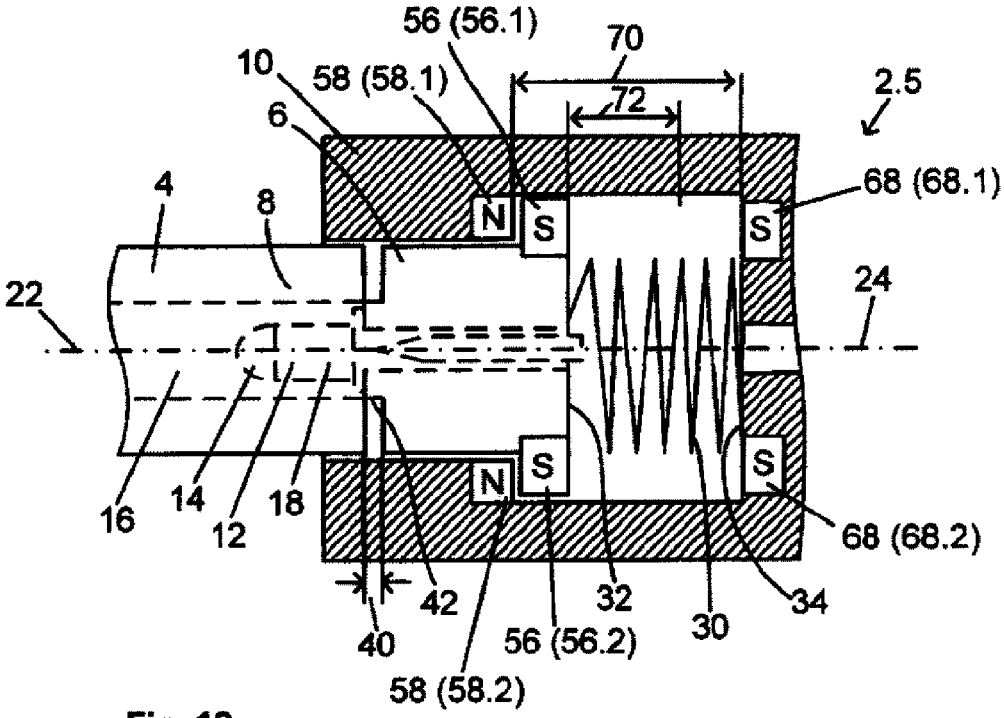
FIG. 12 shows, schematically, a longitudinal section through a further embodiment of a firearm according to the invention, with a breech body being shown in the closed position.
Figure 13:
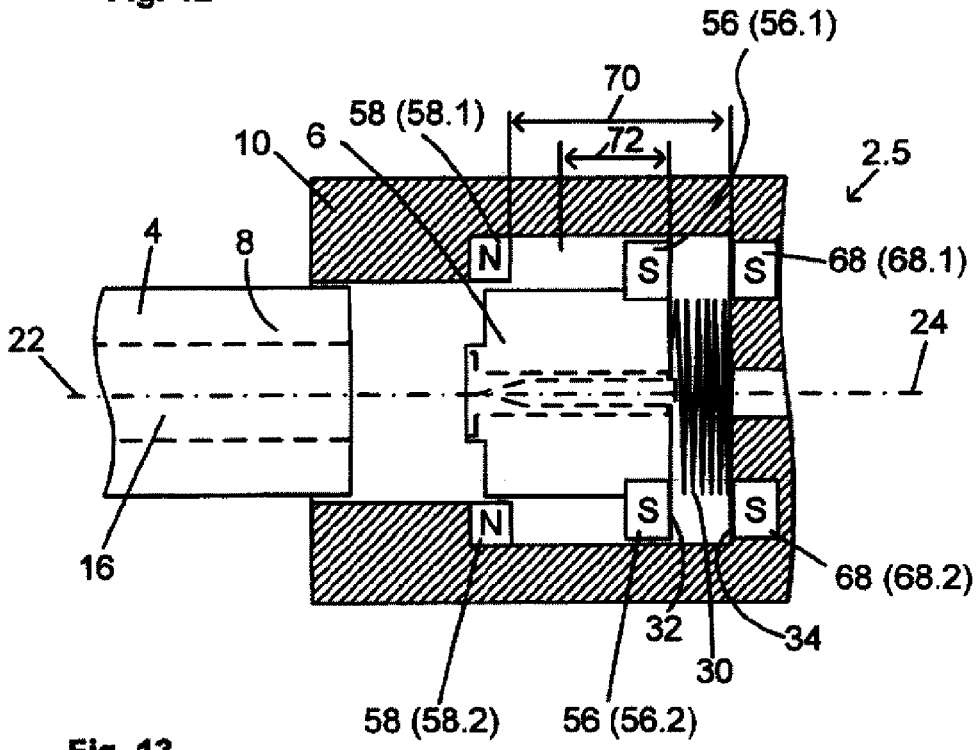
FIG. 13 shows the firearm shown in FIG. 12, with the breech body being shown in the open position.

FIGS. 12 and 13 show a firearm 2.5 according to the invention, in which a permanent magnet 56 of the breech body 6 is arranged, in the longitudinal direction of the barrel 4, axially between a permanent magnet 58 which magnetically attracts it and is arranged axially in a fixed position in the longitudinal direction of the barrel 4, for example two permanent magnets 58.1 and 58.2, and at least one further permanent magnet 68, which magnetically repels it, for example 68.1 and 68.2, with the latter being arranged axially in a fixed position in the longitudinal direction of the barrel 4. For example, the mutually repelling permanent magnets 56 and 68 are arranged with their south poles "S" axially opposite one another, and the at least one permanent magnet 58, which magnetically attracts the permanent magnet 56 of the breech body 6, is, for example, arranged with its north pole axially opposite the south pole of the permanent magnet 56.

The permanent magnet 68 which repels the permanent magnet 56 of the breech body 6 is preferably arranged in the rear wall 34 or on a rear section of the breech guide 10. The permanent magnet 58 which magnetically attracts the permanent magnet 56 of the breech body 6 can be provided in the described manner on or in the cartridge chamber 8 or, corresponding to FIGS. 12 and 13, on or in a front section of the breech guide 10.

The at least one permanent magnet 56 of the breech body 6 can be arranged on or within the breech body 6, or may be formed by the breech body 6 itself, or may be formed corresponding to FIGS. 12 and 13 on a radial annular collar of the breech body 6. The permanent magnets 58 and 68 which magnetically attract and magnetically repel the at least one permanent magnet 56 of the breech body 6 and are axially in a fixed position are arranged at such a long distance 70 from one another in the longitudinal direction of the barrel 4 that the breech body 6 can be moved through a movement distance 72 within this distance 70 in the longitudinal direction of the barrel 4, with this movement distance 72 being that which is required in order to move the breech body between its closed position in FIG. 12 and its open position in FIG. 13.

Figure 14:
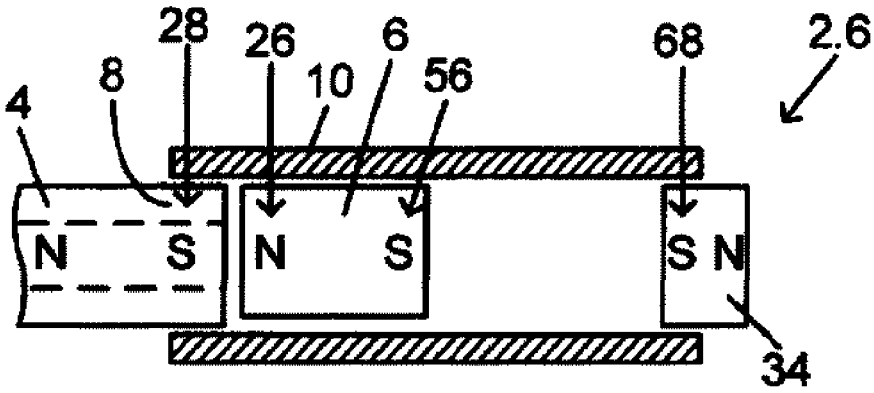
FIG. 14 shows, schematically, a longitudinal section through a further embodiment of a firearm according to the invention.

FIG. 14 shows, schematically, a longitudinal section through a further embodiment of a firearm 2.6 according to the invention, in which the breech body 6 has, at its front end, at least one permanent magnet pole, for example a magnetic north pole "N", and, at the rear end, a dissimilar permanent magnet pole, for example a magnetic south pole "S". The two permanent magnet poles may, for example, be formed by two permanent magnets 26 and 56 or by a single permanent magnet, for example by the breech body 6 itself, if it is in the form of a permanent magnet.

A dissimilar permanent magnet pole, for example a south pole "S", of at least one permanent magnet 28 is located opposite the front permanent magnet pole, for example a north pole "N", of the breech body 6, and is provided on the cartridge chamber 8 (or on another element which is axially in a fixed position relative to it).

A similar permanent magnet pole, for example a south pole "S", of at least one permanent magnet 68 is located opposite the rear permanent magnet pole, for example a south pole "S", of the breech body 6 in the longitudinal direction of the barrel 4 and is arranged axially in a fixed position in the barrel longitudinal direction, for example on or in the rear wall 34, or is formed by means of the rear wall 34, and/or is connected to the breech guide 10.

What is claimed is:

1. A semiautomatic or fully automatic firearm comprising:

a barrel comprising a rear barrel end forming a cartridge chamber configured to receive a projectile from a rear of the cartridge chamber;

a breech guide comprising a rear wall and a breech body positioned in the breech guide between the cartridge chamber and the rear wall such that the breech body moves in a longitudinal direction between an open position, which releases the cartridge chamber in order to load the projectile, and a closed position which closes the cartridge chamber, wherein in the closed position the breech body closes the cartridge chamber at the rear of the cartridge chamber and is configured to be an opposing bearing for the cartridge chamber;

at least one permanent magnet positioned and configured such that, at least in the closed position and in positions close to the closed position, a magnetic force of the at least one permanent magnet urges the breech body to the closed position, such that the magnetic force of the at least one permanent magnet simulates a higher mass of the breech body, the breech body acting as an opposing carrier during the firing of the projectile; and a second permanent magnet positioned to attract the at least one permanent magnet and positioned so as rotate relative to one another about a center axis aligned with an axial bore axis of the barrel, wherein the at least one permanent magnet and the second permanent magnet are rotatable relative to one another between a first rotation angle position in which a north pole is aligned with a south pole and a second rotation angle position in which the north pole is not aligned or less aligned with the south pole, such that the magnetic force between the poles can be reduced by rotation.

2. The firearm according to claim 1, further comprising a second permanent magnet positioned to magnetically attract the at least one permanent magnet in the longitudinal direction of the barrel so as to magnetically draw the breech body to the closed position and to urge the breech body to the closed position when in the closed position.

3. The firearm according to claim 2, wherein the at least one permanent magnet is provided on the breech body, and wherein the at least one second permanent magnet is provided on an element arranged axially in a fixed position in the longitudinal direction of the barrel, wherein the element is the cartridge chamber and/or the breech guide.

4. The firearm according to claim 1, wherein the at least one permanent magnet is provided on the breech body or on an element which is arranged axially in a fixed position in the longitudinal direction of the barrel, and the element or the breech body is composed of a ferromagnetic or ferrimagnetic material magnetically attracted by the at least one permanent magnet in the longitudinal direction of the barrel, or contains a material such that the breech body and the element are magnetically attracted to one another in the longitudinal direction of the barrel.

5. The firearm according to claim 4, wherein the at least one permanent magnet is positioned on the breech body and the at least one second permanent magnet is positioned axially in a fixed position in the longitudinal direction of the barrel, and the element is positioned in a fixed position with the cartridge chamber in the longitudinal direction of the barrel.

6. The firearm according to claim 1, further comprising an element positioned opposite in the barrel longitudinal direction to the at least one permanent magnet and magnetically attracted to the at least one permanent magnet when the breech body is in the closed position, wherein the at least one permanent magnet is arranged such that an air gap remains between the at least one permanent magnet and the element.

7. The firearm according to claim 1, further comprising a third permanent magnet positioned to magnetically repel the at least one permanent magnet in the barrel longitudinal direction so as to magnetically force the breech body to the closed position.

8. The firearm according to claim 7, wherein at least one of the at least one permanent magnet and the third permanent magnet is provided at a rear end of the breech body, and the other one of the at least one permanent magnet and the third permanent magnet is arranged on the rear wall opposite the cartridge chamber at a distance in the barrel longitudinal direction, such that the breech body is magnetically forced against the cartridge chamber by means of the mutually repelling permanent magnets in the direction away from the rear wall towards the cartridge chamber.

9. The firearm according to claim 1, wherein the breech body has at least one permanent magnet which is located, over an entire movement distance of the breech body between its closed position and its open position, between at least one second permanent magnet which magnetically attracts the at least one permanent magnet to the closed position and at least one third permanent magnet which magnetically repels the at least one permanent magnet to the closed position.

10. The firearm according to claim 1, wherein the breech body is magnetized as a permanent magnet forms the at least one permanent magnet.

11. The firearm according to claim 1, further comprising at least one spring positioned so as to force the breech body to the closed position.

12. The firearm according to claim 1, wherein the firearm is a rifle.

13. The firearm according to claim 1, wherein the firearm is a pistol.

14. The firearm according to claim 1, wherein the barrel and the cartridge chamber magnetized as a permanent magnet forms the at least one permanent magnet.

* * * * *